United States Patent [19]

Kronberg

[11] Patent Number: 4,952,892

[45] Date of Patent: Aug. 28, 1990

[54] WAVE GUIDE IMPEDANCE MATCHING METHOD AND APPARATUS

[75] Inventor: James W. Kronberg, Beech Island

[73] Assignee: The United States of America as represented by the United States Department of Energy, Washington, D.C.

[21] Appl. No.: 350,817

[22] Filed: May 12, 1989

[51] Int. Cl.[5] ..... H01P 5/08

[52] U.S. Cl. ..... 333/34; 333/35; 333/239; 350/96.15

[58] Field of Search ..... 350/96.15, 96.16; 343/772, 860; 333/33–35, 239, 248

[56] References Cited

U.S. PATENT DOCUMENTS

| | | | |
|---|---|---|---|
| 2,109,843 | 3/1938 | Kassner | 333/34 X |
| 2,516,944 | 8/1950 | Barnett | 333/34 X |
| 2,880,398 | 3/1959 | Alford | 333/22 R |
| 2,970,284 | 1/1961 | Goubau | 333/34 |
| 3,121,850 | 2/1964 | Arlt . | |
| 3,508,175 | 4/1970 | Alford | 333/33 |
| 3,539,951 | 11/1970 | Tischer | 333/34 |
| 3,828,282 | 8/1974 | Endersz | 333/22 R |
| 3,828,303 | 8/1974 | Sladek et al. . | |
| 3,916,350 | 10/1975 | Swan | 333/32 |
| 4,200,356 | 4/1980 | Hawkes et al. | 350/96.16 |

FOREIGN PATENT DOCUMENTS

| | | | |
|---|---|---|---|
| 2653815 | 6/1977 | Fed. Rep. of Germany | 350/96.16 |

*Primary Examiner*—Paul Gensler

*Attorney, Agent, or Firm*—Stephen D. Hamel; William R. Moser; Richard E. Constant

[57] ABSTRACT

A technique for modifying the end portion of a wave guide, whether hollow or solid, carrying electromagnetic, acoustic or optical energy, to produce a gradual impedance change over the length of the end portion, comprising the cutting of longitudinal, V-shaped grooves that increase in width and depth from beginning of the end portion of the wave guide to the end of the guide so that, at the end of the guide, no guide material remains and no surfaces of the guide as modified are perpendicular to the direction of energy flow. For hollow guides, the grooves are cut beginning on the interior surface; for solid guides, the grooves are cut beginning on the exterior surface. One or more resistive, partially conductive or nonconductive sleeves can be placed over the exterior of the guide and through which the grooves are cut to smooth the transition to free space.

26 Claims, 6 Drawing Sheets

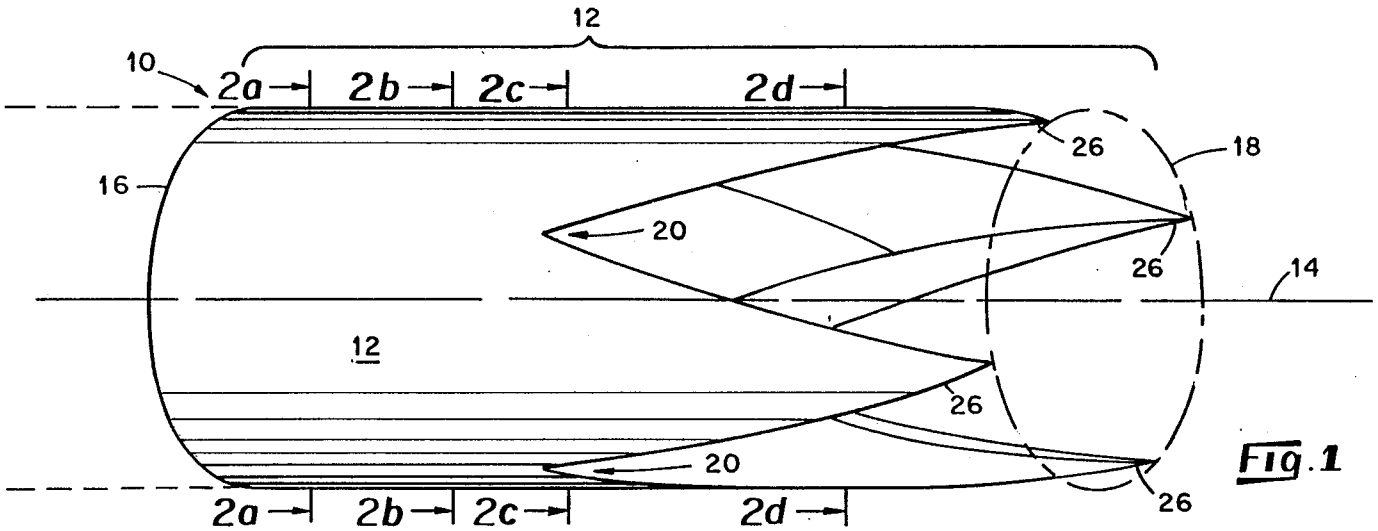
Fig. 1
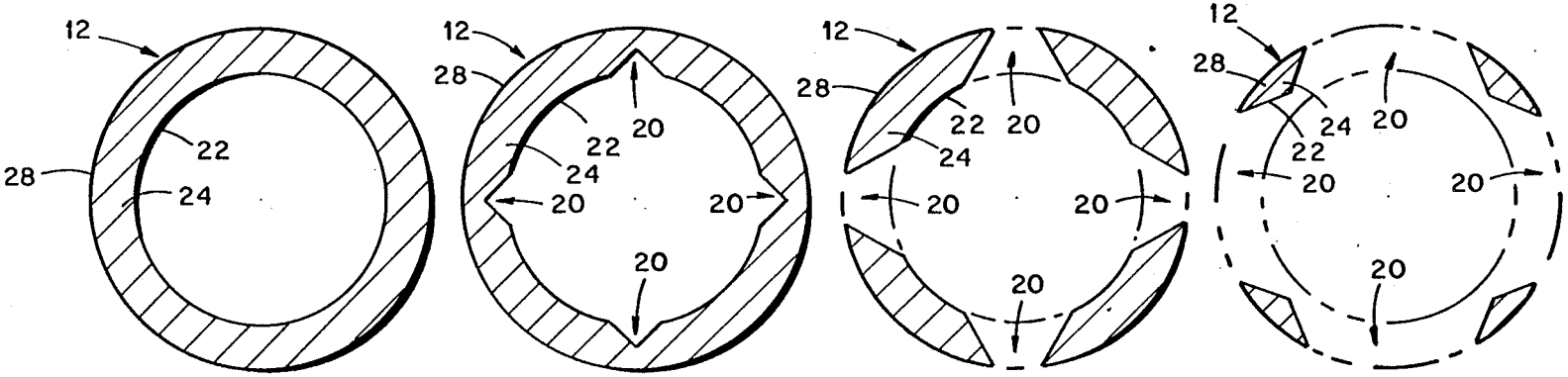
Fig. 2a
Fig. 2b
Fig. 2c
Fig. 2d 12
10
16
18
26
20
20
a
b
c
≥1/4 λ
≥1/4 λ
≥1/4 λ

14
26
26
26
28
28
10
16
22
24
12

WAVE GUIDE IMPEDANCE MATCHING METHOD AND APPARATUS

BACKGROUND OF THE INVENTION

1. Field of the Invention and Contract Statement

The United States Government has rights in this invention pursuant to Contract No. DE-AC09-76SR00001 between the U.S. Department of Energy and E.I. DuPont de Nemours & Co.

The present invention relates to a method and apparatus for matching the impedance of a wave guide to that of free space.

2. Discussion of Background and Prior Art

Guided energy, in various forms, is becoming ever more important in modern technology. Low frequency electromagnetic energy, such as radio waves, travels along transmission lines made up of wires, strips or concentric layers of metal. Microwaves are often channeled through round or rectangular metal wave guides on their way to data-transmission, sensing or heating applications. Acoustic waves may be carried in wave guides for measuring distances or product levels in containers. Millimeter waves, infrared, visible and ultraviolet light are carried through plastic or glass rods or fibers, sometimes for many miles.

In each case, the energy must pass through abrupt transitions in guide characteristics: upon entering the guide, upon leaving the guide, and wherever along the transmission path the guide is spliced or other changes occur in the transmitting medium. At such transitions, part of the energy is usually reflected back through the guide toward the source as an "echo", and thereby lost. Unless special measures are taken to minimize reflections, losses at a few transition points may exceed those occurring in many feet or even miles of guided travel.

Guided energy reflections result from a mismatch in the impedances at adjacent points along the wave guide. The concept of impedance, although rigorously defined only for electromagnetic transmission lines and waveguides, may be applied in a broader sense to guides carrying acoustic and optical energies as well. In all of these fields, principles derived from transmission line theory may be applied to minimize losses.

Matching between transmission lines of differing impedances is best accomplished, when physical dimensions permit, by tapering a section of the line so impedance changes smoothly with distance and is equal at each end to that of the guide adjacent thereto. The tapered section spreads out energy reflections in space and time so that they partly or completely cancel each other out. While other techniques for impedance matching exist, using a tapered section has the advantage of providing good matches over a very broad band of energy wavelengths as long as the tapered section extends for a quarter wavelength or more of the energy carried by it. A disadvantage in some cases can be the physical size of the tapered section needed to match long wavelengths.

An analogous technique is used in wave guides, regardless of the type of energy carried, when this energy must be coupled to free space. Tapered matching sections called horns are often used for this purpose. In its simplest form, such a horn consists merely of a flared section at the end of the guide. A familiar example is the bell of a trumpet: a tapered matching section between a round acoustic wave guide and free space, providing a fairly good impedance match over the entire frequency range of the instrument.

Since perfect coupling to free space would require a horn infinitely wide at its outer end, finite, imperfect horns always lose some energy through reflection. As a compromise between performance and size, a horn is usually flared to some large fraction of the wavelength, or even to many wavelengths if this is practical. Occasionally, space limitations require that a very small horn, or none at all, be used. In this case, a severe penalty is paid in terms of energy loss because much of the incident energy never leaves the guide, but is reflected internally and lost.

A parallel situation exists when solid guides, such as glass or plastic fibers, are used to transmit millimeter waves or various types of light. In this case no horn structure is possible, since at some point an interface would have to be made between air and the solid medium and reflection would occur at that point. Most commonly, solid guides simply end in flat surfaces. While easy to manufacture, these give far from ideal performance. Performance can be improved somewhat by applying a one-quarter-wavelength-thick coating of a material of intermediate refractive index (or dielectric constant) to the wave guide end. This method, however, is effective only at or near the design wavelength and cannot be adapted to broadband transmission.

SUMMARY OF THE INVENTION

An object of the invention is to provide a method and apparatus for improving the match in impedance between a wave guide and free space.

Another object of the invention is to provide an impedance matching method adaptable to a variety of wave guides carrying wave energy including acoustical, electromagnetic and optical.

To achieve the foregoing and other objects and in accordance with the purpose of the invention, as embodied and broadly described herein, the invention comprises a method of modifying an end portion of a wave guide to greatly reduce reflected energy as the wave travels from the guide to free space by forming grooves in the guide material in the shape of increasingly larger triangular sections leaving increasingly smaller, triangular "teeth". In a preferred embodiment, toothed sleeves of interfacing material placed over the guide end portion further reduce reflections. Provided that the end portion is at least three-quarters wavelength, and more preferably several wavelengths in length, little energy reflection occurs.

This method avoids the space requirements of horn-type matching sections and the frequency limitations of other impedance matching techniques while providing higher efficiency in wave guides.

Reference is now made in detail to the present preferred embodiment of the invention, an example of which is given in the accompanying drawings.

A BRIEF DESCRIPTION OF THE DRAWINGS

The accompanying drawings, which are incorporated in and form a part of the specification, illustrate the invention and, together with the description, serve to explain the principles of the invention. In the drawings:

FIG. 1 is a perspective view of the present invention as applied to a hollow, cylindrical wave guide. FIGS. 2*a*, 2*b*, 2*c* and 2*d* are cross-sectional views of the wave guide of FIG. 1 taken along lines 2a—2a, 2b—2b, 2c—2c and 2d—2d, respectively.

Figure 6:
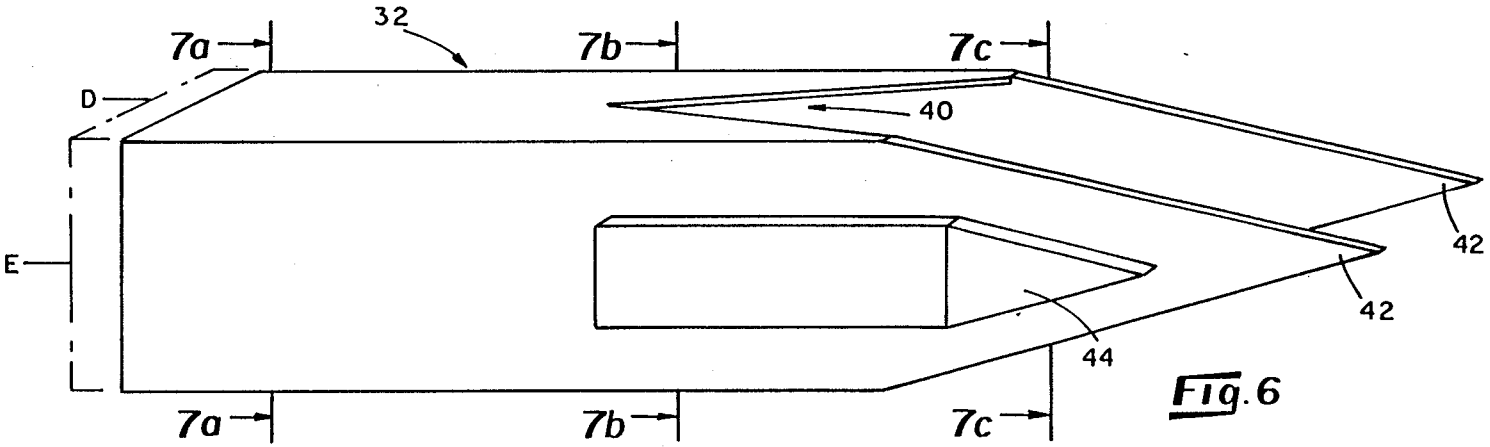
FIG. 6 is a perspective view of a hollow, rectangular wave guide for transverse electric mode (TE) transmission showing stiffening according to the present invention.
Figure 7A:
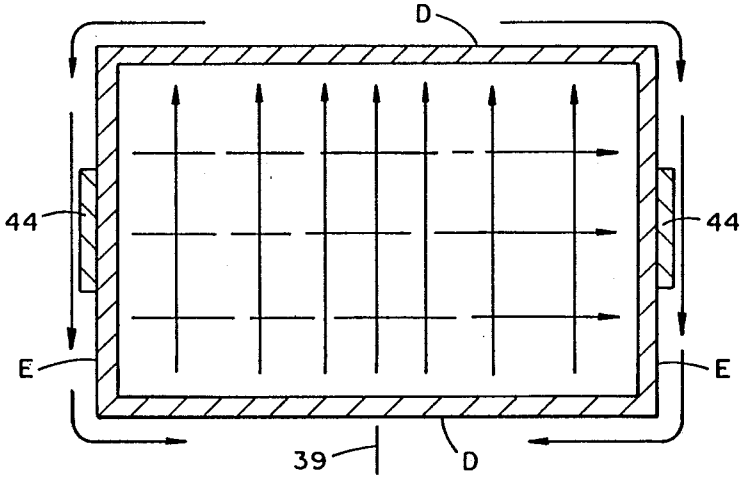
Figure 7B:
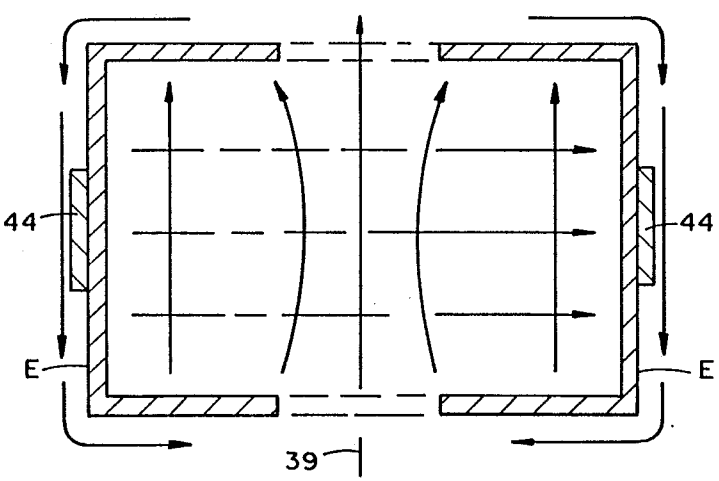
Figure 7C:
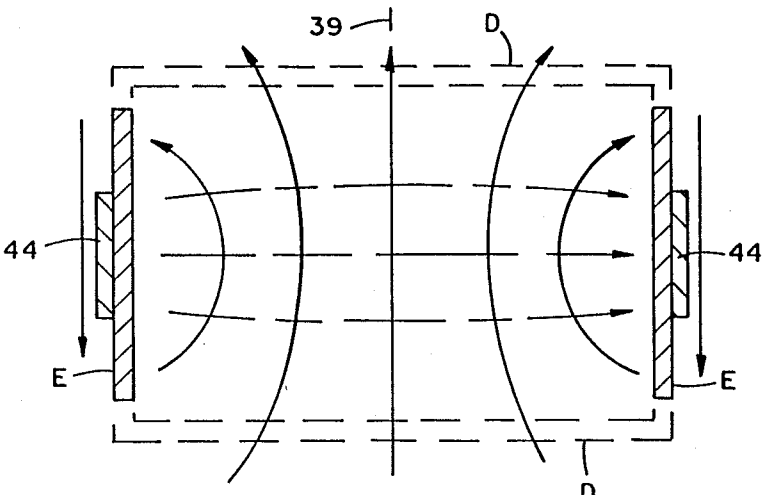
Figure 7D:
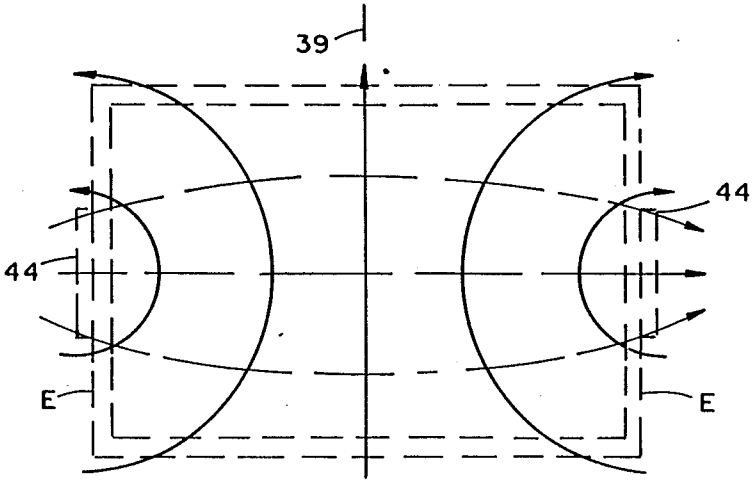

FIGS. 7a, 7b [and 7c], 7c and 7d are cross-sectional views of FIG. 6 showing TE field strength lines, along lines 7a—7a, 7b—7b [and 7c—7c], 7c—7c and 7d —7d, respectively, according to the present invention.

Figure 8A:
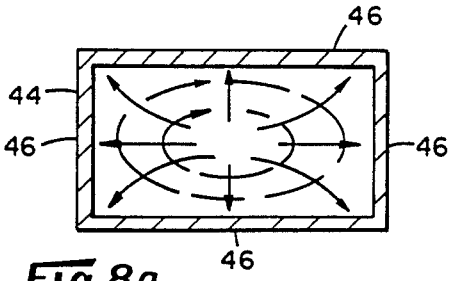
Figure 8B:
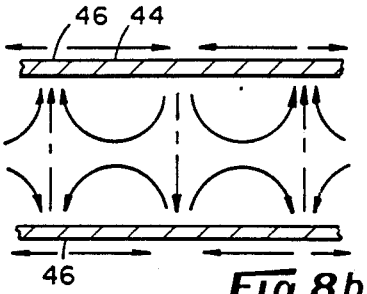

FIGS. 8a and 8b are cross-sectional views of a rectangular wave guide showing transverse magnetic (TM) field strength lines.

Figure 9:
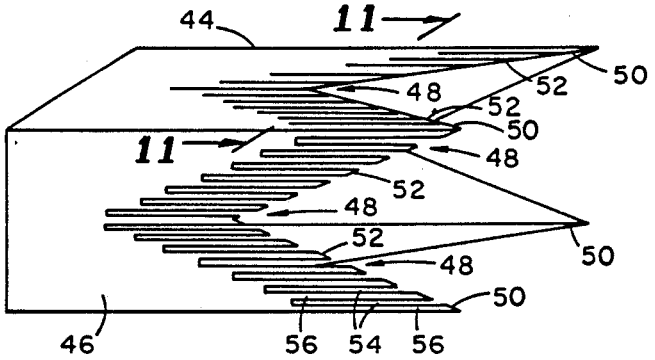

FIG. 9 is a perspective view of an alternative rectangular wave guide adapted for TM mode transmission of microwave energy according to the present invention.

Figure 10:
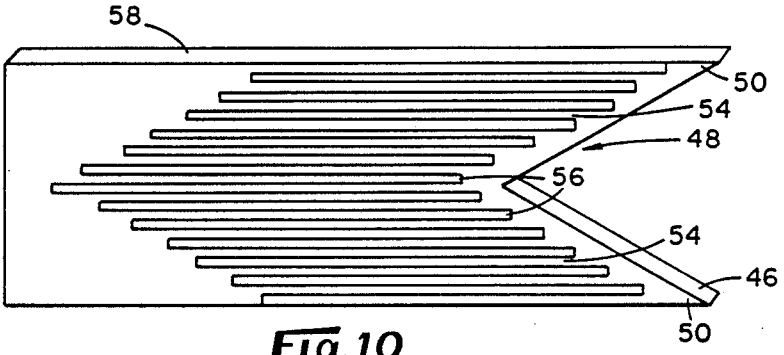

FIG. 10 is a detailed view of a side panel of the rectangular wave guide shown in FIG. 9 according to the present invention.

Figure 11:
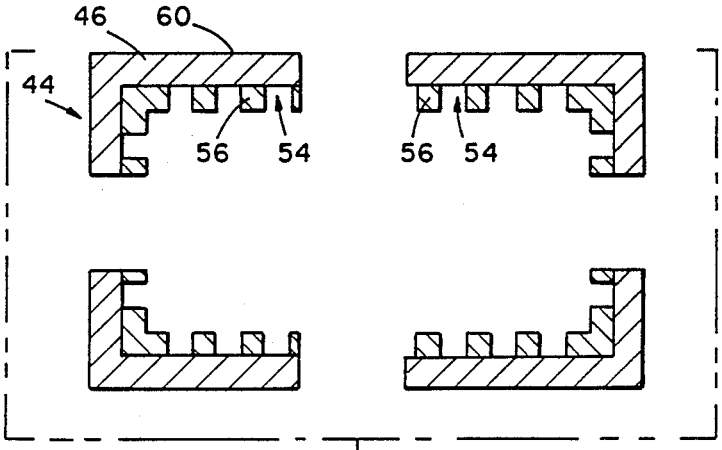

FIG. 11 is a cross sectional view of the rectangular wave guide of FIG. 9 along lines 11—11 according to the present invention.

Figure 12:
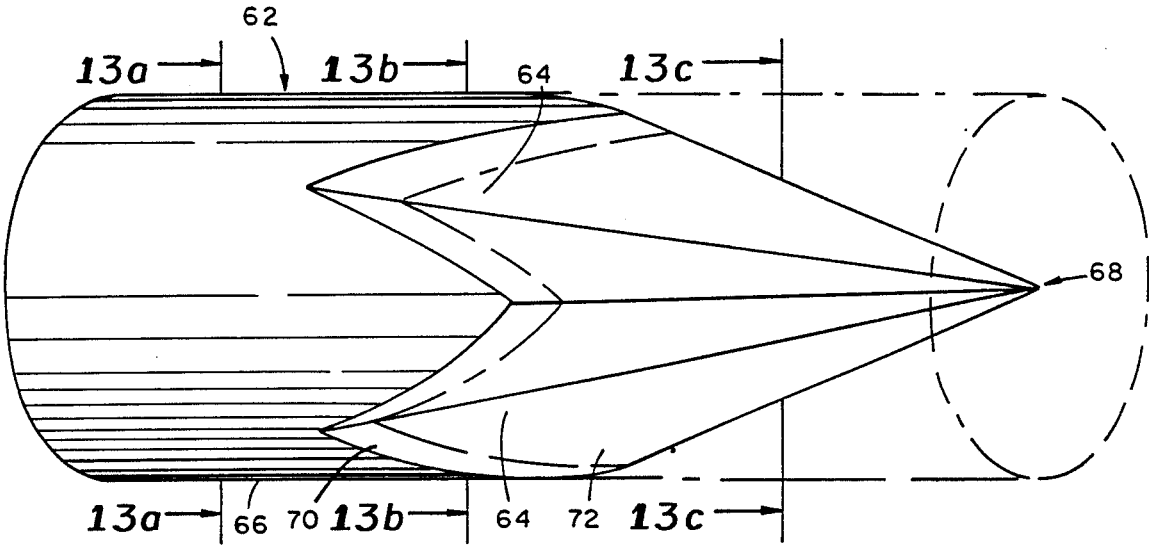

FIG. 12 is a perspective view of a rod-shaped wave guide according to the present invention.

Figure 13A:
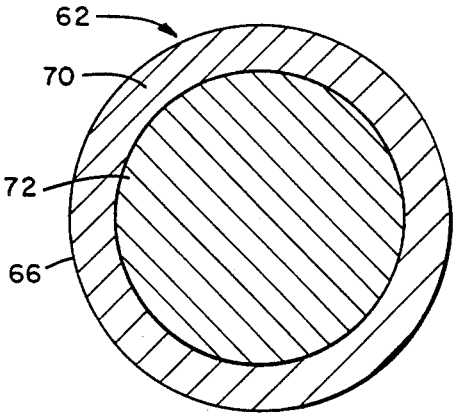
Figure 13B:
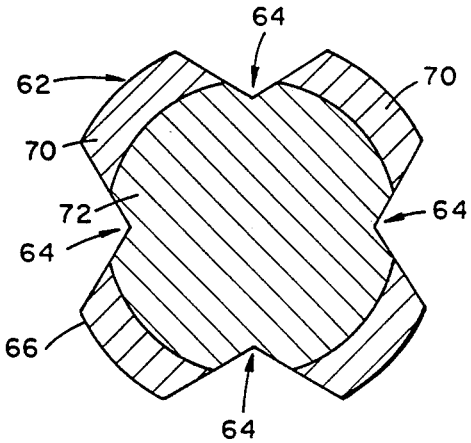
Figure 13C:
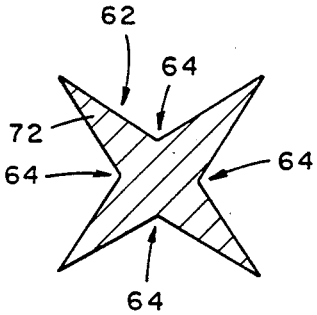

FIGS. 13a, 13b, 13c are cross sectional views of the wave guide of FIG. 12 along lines 13a—13a, 13b—13b and 13c—13c, respectively, according to the present invention.

DETAILED DESCRIPTION OF THE INVENTION

FIG. 1 shows the present invention embodied in a cylindrical, hollow wave guide 10, having an end portion 12, such as is used for carrying acoustic or microwave energy therein. The energy is carried within wave guide 10 parallel to the longitudinal axis 14 of wave guide 10. For acoustic use, wave guide 10 may consist of any smooth material; for microwave energy, the material of wave guide 10 is typically composed of copper or brass, and preferably silver-plated on the interior surface.

End portion 12 of wave guide 10 has a first end 16 that is continuous with wave guide 10 and a second end 18 that terminates at free space.

The method of the present invention involves the cutting away of material from end portion 12 of wave guide 10 to form a plurality of longitudinal, V-shaped grooves 20, best seen in FIGS. 2a-2d, about the periphery of end portion 12, beginning near first end 16 and continuing to second end 18, making grooves 20 wider and deeper so that, at second end 18 where end portion 12 meets free space, all material is cut away.

Figure 3:
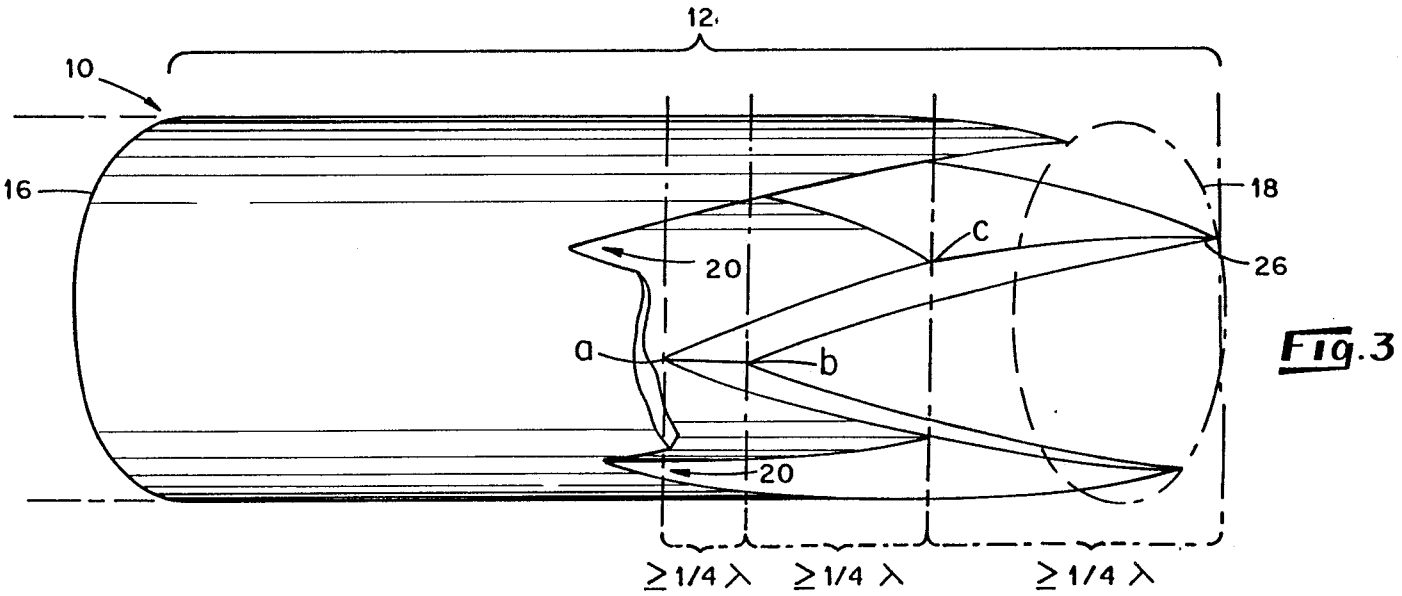
FIG. 3 shows a cross-sectional, lengthwise view of the wave guide of FIG. 1 according to the present invention.

For hollow wave guide 10 carrying energy on the interior, as best seen in FIGS. 2a-2d, grooves 20 are V-shaped sections on the interior surface 22 of wave guide wall 24. As grooves 20 become larger, they pierce wave guide wall 24; as they continue to become larger, adjacent grooves 20 intersect to form pointed "teeth" 26 in end portion 12. As best seen in FIG. 3, the distance along longitudinal axis 14 of end portion 12 from the beginning of grooves 20 at "a" to the point "b" at which grooves 20 pierce guide wall 24 is preferably at least one-quarter wavelength ($\frac{1}{4}\lambda$) in length. The distance along longitudinal axis 14 of end portion 12 from b to the point at which grooves 20 intersect at "c" is also preferably at least one-quarter wavelength ($\frac{1}{4}\lambda$) in length. Finally, the distance along axis 14 from c to second end 18 is also preferably at least one-quarter wavelength ($\frac{1}{4}\lambda$). Grooves 20 may also be of dissimilar lengths.

It will be obvious that only interior surface 22 of end portion 12 is important; exterior surface 28 of end portion 12 does not have to be of the same contour as interior surface 22 so that the thickness of wave guide wall 24 may vary. Therefore, end portion 12 may be machined from a thick-walled tube or formed from plain sheeting or plain tubing by stamping, deep-drawing or other techniques. A backing material may then be added to stiffen teeth 26. Alternatively, the desired contour could be molded from plastic or similar material, and a metallic surface added (if required) by vacuum deposition, electroforming or other appropriate methods in a later stage of fabrication.

When microwave energy propagates through a hollow metallic guide, patterns of circulating current are set up in the walls of the guide. Many different patterns, or modes of energy distribution are possible within the guide, but they fall mainly into two families: transverse electric (TE) and transverse magnetic (TM). Each transmission mode sets up a different pattern of current. In the TE mode, current flows circumferentially around the guide, whereas in the TM mode, current flows parallel to longitudinal axis 14.

Any sudden change in the geometry of interior surface 20 will change the pattern of these currents, almost always causing an impedance mismatch and reflecting energy back along the guide. In the wave guide of FIG. 1, a sudden change in circumferential, TE mode, current flow occurs where grooves 20 first separate end portion 12 into teeth 26. Similarly, TM-mode reflections could occur at the ends of teeth 26.

Figure 4:
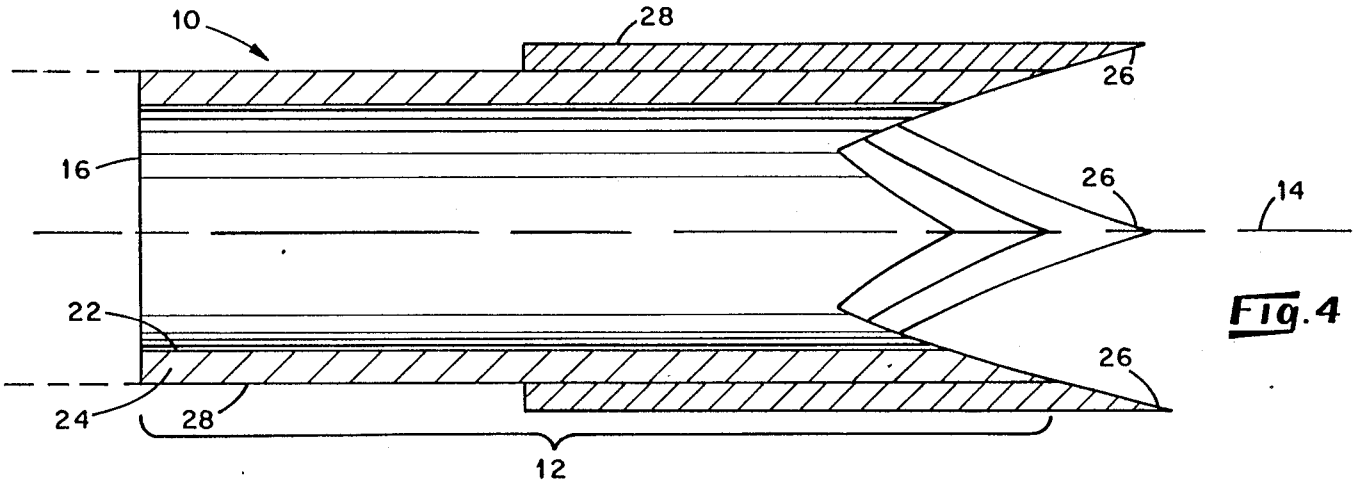
FIG. 4 shows a cross-sectional views of the wave guide of FIG. 1 having a resistive sleeve according to the present invention.

The modifications to wave guide 10 shown in FIG. 4 are intended for use with microwave energy of unknown mode or polarization, or when multiple modes and polarizations are likely to be present; this is typically the case when a round guide is used. A resistive sleeve 28 is added to end portion 12, making close electrical contact. Sleeve 28 is treated to make its conductivity decrease smoothly with length. This may be done through geometry, by roughly copying the toothed configuration of end portion 12 as shown in FIG. 4, by changes in sleeve composition, or by a combination of these methods.

Possible materials for sleeve 28 are carbon or inorganic resistive materials, conductive polymers such as iodine-doped polyacetylene, or nonconductive polymers such as synthetic rubber if filled with conducting particles. While lower in conductivity, the latter have the advantage of being elastic, so that sleeve 28 can be made slightly undersized and pressed over end portion 12, drawn tight by its own elasticity. A combination of materials, such as an unfilled rubber outer cylinder surrounding an inner cylinder conductively filled, could also be used.

An alternative structure (not shown) might consist of a rigid sleeve, of either resistive or nonconductive material, with a metallic inner section formed by a thin layer of metal deposited on the inner surface of sleeve 28 in a configuration geometrically similar to end portion 12. If made of a nonconductive material, sleeve 28 could also be coated with a resistive layer. A variety of techniques could be used to form such a layered structure. Using thick-film hybrid circuit materials, for instance, sleeve 28 could be formed of an alumina ceramic, a resistive layer established by one or more applications of pyrolytic carbon, and a conductive layer formed by silver-paste metallization.

Bridging the spaces between teeth provides a smooth transition from high to low conductivity: in effect, a "buffer zone" for TE-mode currents. Similarly, the region of falling conductivity beyond the ends of the teeth provides a "buffer zone" for TM-mode currents. If each zone extends for a quarter-wavelength or more beyond the conducting edge, little or no reflection will occur.

Figure 5:
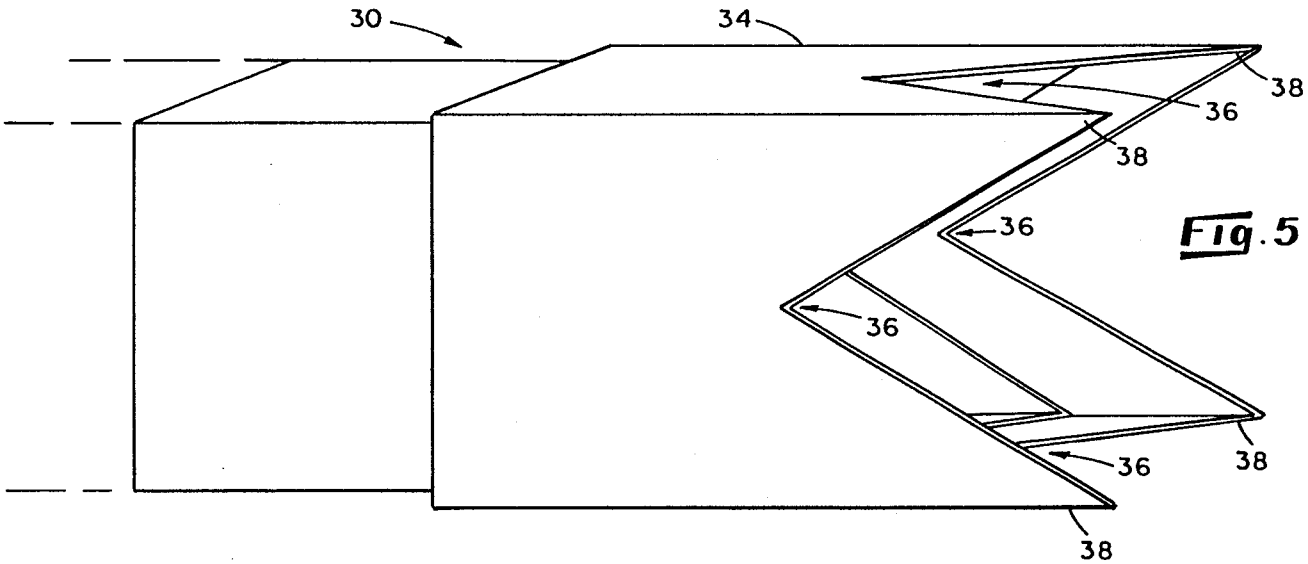
FIG. 5 is a perspective view of a hollow, square wave guide with a sleeve according to the present invention, for use with any transmission mode or mixture of modes.

This method could also be used with a square waveguide 30 or a rectangular waveguide 32, the matching section conforming to the shape of the respective wave guide. Since square guide 30, as shown in FIG. 5, is typically used with two simultaneous transmissions of differing and mutually perpendicular polarization, a resistive sleeve 34 would be needed for best performance. Four grooves 36 would preferably be formed, one at the center line of each side of wave guide, forming four teeth 38 projecting at the corners of the guide 30. This would provide each tooth 38 with a 90 degree crease, adding strength at no cost in size, weight or performance. A similar technique would be used with rectangular guides.

FIG. 6 shows a specific adaptation of this method for use with rectangular waveguide 32 when a single dominant mode of energy with known polarization is present; rectangular guides are frequently used in this manner. In such a case the matching technique may be simplified and a resistive sleeve, which will inevitably cause some energy loss through resistive heating, may be eliminated.

The most commonly used transmission mode in rectangular guide 32 is $TE_{10}$, the simplest of the electromagnetic transmission family. This mode is favored because it most closely approximates the mode of a wave traveling in free space. When rectangular waveguide 32 has dimensions D and E (with $D>E$) and is viewed in cross section as shown in FIG. *7a*, the $TE_{10}$ mode is characterized by electric field lines (shown as solid lines in FIGS. *7a*, *7b* and *7c*) running perpendicular to the length of guide 32 from one "D" wall to the other, and magnetic field lines (shown as dashed lines in FIGS. *7a*, *7b* and *7c*) forming closed eddies parallel to "D". Electric field lines also form closed loops, returning as circulating currents carried chiefly by the "E" walls, with essentially zero current at the center of each "D" wall at 39.

To form an impedance matching section in rectangular wave guide 32, each "D" wall is split at zero-current line 39 by a groove 40 similar in geometry to groove 20 in FIG. 1. Grooves 40 broaden until two teeth 42 are formed on the "E" wall. Preferably, groove 40 of the "D" wall and tooth 42 on the "E" wall would each be a quarter-wavelength in length or longer. If the section were of light material or subject to rough use, each tooth 42 would preferably have a thickened reinforcing section 44 projecting toward the outside.

Successive cross-sections in FIGS. *7a*, *7b*, *7c* and *7d* through rectangular wave guide 32 show the progressive reshaping of the field lines as energy passes through grooves 40. FIG. *7a* shows the field lines in unmodified waveguide 32. In FIG. *7b*, grooves 40 are present although still narrow and electric field lines begin to penetrate it, while magnetic field lines and return current paths are not much affected. In FIG. *7c*, grooves 40 are wider and electric field lines mostly extend outward through them with only a fraction of current returning through the "e" walls, and magnetic lines also begin to stretch and leave guide 32. Finally, in FIG. *7d*, all wall material is cut away and the field lines approximate those of a wave in free space.

FIGS. 8 through 11 show a similar adaptation of the technique for use with a rectangular waveguide 44 carrying microwaves predominantly in the $TM_{11}$ mode. While somewhat less frequently used than $TE_{10}$, $TM_{11}$ is the mode of choice in systems containing rotating parts, such as antennas, since the energy is essentially nonpolarized. Because of its lack of polarization, $TM_{11}$ energy may be transmitted with equal ease through round, square or rectangular guide. While illustrated for rectangular guide 44, the method may be used with any of these.

A cross-section perpendicular to the direction of transmission through guide 44, illustrated in FIG. *8a*, shows electric field lines (indicated by solid lines) flowing radially to walls 46 while magnetic lines (indicated by dashed lines) form closed loops perpendicular to the length of guide 44. A cross-section taken lengthwise along guide 44, illustrated in FIG. *8b*, shows electric lines forming curves touching walls 46 at both ends, with return current flowing parallel to the length of wave guide 44.

Guide impedance is matched by cutting a plurality of grooves 48 in the way previously described, in any convenient number and distribution, separating wall 46 into teeth 50. In square or rectangular waveguides, for reasons explained above, four grooves 48 are preferably used: one beginning at the center of each wall 46, and dividing walls 46 into four teeth 50 extending from the corners of the guide.

In order that electric currents may not be diverted by the slanting edges 52 and concentrated at the ends of teeth 50, causing reflections, each edge 52 is divided by lengthwise slots 54 into a plurality of narrow extensions 56 at least a quarter wavelength long. For square or rectangular guides, these are conveniently fabricated using panels 58 of single-sided printed circuit board with the desired pattern etched into the metal cladding, or using the thick-film techniques. Panels 58 are attached to the end of an unmodified rectangular wave guide, forming a composite assembly 60. Assembly 60 is shown in FIG. 11 in cross-section taken along lines 11—11 of FIG. 9.

FIG. 12 shows a modification of the basic technique applied to a round wave guide 62 such as a dielectric rod or an optical fiber. A similar modification could be used with solid guide of other shapes.

A dielectric rod is most commonly used with millimeter-length waves, and fibers with infrared, visible or ultraviolet light. In all cases, the energy is confined to the wave guide and its close vicinity by total internal reflection. No electric currents are set up in the guide material, which is nonconductive, but a stepped or graded change in dielectric constant or refractive index has a similar effect, save that electric and magnetic field loops extend outward into the space immediately surrounding the fiber. An outer jacket, of lower refractive index or dielectric constant than the core, may be provided as a "buffer zone" to prevent these fields from interacting with outside objects and dissipating energy or causing changes in impedance.

An adaptation of the invention may be applied to wave guide 62. As with the hollow guides previously described, shallow V-shaped grooves 64 are cut into the guide 62 and become progressively wider and deeper toward the end of the guide. Here, however, grooves 64 begin at outer surface 66 and extend progressively further toward the center with distance, widening to obliterate outer surface 66 and converge to a single point 68 corresponding to the original end of wave guide 62 before modification, here shown in outline only. The method is the same regardless of whether or not an outer jacket 70 is used to cover a guide core 72, and regardless of the thickness if jacket 70 is present.

Cross sections 13*a*, 13*b* and 13*c* through guide 62 along lines 13*a*—13*a*, 13*b*—13*b* and 13*c*—13*c*, respectively, further illustrate the technique. FIG. 13*a* shows the unmodified guide with jacket 70 and core 72. In FIG. 13*b*, grooves 64 have penetrated jacket 70 and have started to penetrate core 72. In FIG. 13*c*, jacket 70 is gone and only core 72 remains, tapering toward point 68.

Provided that at least a quarter-wavelength of guide 62 extends between the start of groove 64 and the end of jacket 70, and between the end of jacket 70 and point 68, little or no energy should be lost to reflection. Emerging energy will typically be confined to a star-shaped pattern in free space, its exact form depending on the mode or combination of modes present in guide 62, but with its overall symmetry, orientation and number of lobes roughly corresponding to those of the tapered section of guide 62.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A method for matching the impedance of a hollow wave guide to the impedance of free space, said wave guide having a wall with an inside surface and an outside surface, an end portion with a first end continuous with said wave guide and a second end opposite said first end, said second end adjacent free space, which method comprises the step of:

cutting a plurality of grooves in said end portion beginning at said first end on said inside surface of said wall and running longitudinally to said second end, said grooves increasing in width and depth from said first end to said second end, penetrating said wall and intersecting at said second end.

2. The method of claim 1 wherein said grooves are formed so that no surface of said guide with said grooves cut therein is perpendicular to the long dimension of said wave guide.

3. The method of claim 2 wherein said end portion is at least three-quarters of one wavelength in length.

4. The method of claim 1 wherein said grooves are cut to have triangular cross-sections so that said grooves are V-shaped.

5. The method of claim 1 wherein said grooves are centered longitudinally about said end portion at locations where the field strength of energy carried by said guide is minimum.

6. The method of claim 1 wherein said grooves penetrate the outside surface of said wall at least one-quarter wavelength along the long axis of said wave guide from said end portion.

7. The method of claim 6 wherein said grooves first intersect at least one-quarter wavelength from where said grooves penetrate said outside surface of said wall.

8. The method of claim 7 wherein said second end is at least one-quarter wavelength from where said grooves first intersect.

9. The method of claim 7 further comprising the step of adding backing to said end portion to stiffen said end portion.

10. The method of claim 1 further comprising the step of covering the exterior of said end portion of said wave guide with one or more resistive sleeves extending beyond said second end of said end portion and through which sleeve said grooves are cut so that the transition between said wave guide and free space is smoothed.

11. The method of claim 1 wherein said waveguide is a solid rod having an outside surface and carrying energy therein and wherein the step of cutting said grooves begins at said outside surface at said first end so that said rod is reduced to a point at said second end as said grooves widen and deepen.

12. A hollow wave guide having a wall with an inside surface and an outside surface and having improved impedance matching between said wave guide and free space, said hollow waveguide comprising:

an end portion having a first end continuous with said wave guide and a second end bounded by free space;

said end portion having a plurality of longitudinal grooves running from said first end to said second end;

said grooves having increasing width and depth from said first end to said second end; and said grooves beginning on said inside surface of said wave guide and piercing said outside surface of said wall as said grooves run from said first end to said second end.

13. The wave guide of claim 12 wherein said grooves have a triangular cross-section.

14. The wave guide of claim 13 wherein said grooves each have different triangular cross-sections at any plane transverse to said end portion.

15. The wave guide of claim 12 wherein said grooves are centered longitudinally about said wave guide where the field strength of the carried energy is minimum.

16. The wave guide of claim 12 wherein said grooves are at least three-quarters of a wavelength in length.

17. The wave guide of claim 16 wherein said grooves are at least two wavelengths in length.

18. The wave guide of claim 17 wherein said grooves first pierce said outside surface at least one-quarter wavelength from said first end.

19. The wave guide of claim 18 wherein said grooves first intersect at least one-quarter wavelength from where said grooves first pierce said outside surface of said wall.

20. The wave guide of claim 19 wherein said second end is at least one-quarter wavelength from where said grooves first intersect.

21. The wave guide of claim 12 wherein said wave guide further comprises a solid rod having an outside surface and said grooves begin on said outside surface and intersect to form a point at said second end as said grooves widen and deepen.

22. The wave guide of claim 12 further comprising one or more resistive sleeves about the outside surface of said end portion, said grooves penetrating said one or more sleeves, for smoothing the transition from said wave guide to free space.

23. A solid waveguide for carrying wave energy and having improved impedance matching with free space, said wave guide comprising:

an end portion having a first end continuous with said wave guide, a second end bounded by free space and an outside surface;

said end portion having a plurality of longitudinal, shallow, V-shaped grooves running from said first end to said second end; and said grooves having increasing width and depth from said first end to said second end and beginning on said outside surface and converging to a point at said second end.

24. The waveguide of claim 23 further comprising a means surrounding said end portion for reducing dissipation of said carried energy through said outside surface.

25. The wave guide of claim 24 wherein said reducing means is a jacket in contact with said outside surface, said jacket having lower refractive index or lower dielectric constant than said end portion.

26. The wave guide of claim 23 wherein said grooves have a length equal to at least three-quarters wavelength of said carried energy.

* * * * *